US011219562B2

(12) United States Patent
Roider et al.

(10) Patent No.: US 11,219,562 B2
(45) Date of Patent: Jan. 11, 2022

(54) MOBILE STRETCHER

(71) Applicant: HAWE Altenstadt Holding GmbH, Altenstadt (DE)

(72) Inventors: Peter Roider, Lappersdorf (DE); Andreas Meyer, Regendorf (DE); Christian Hart, Regensburg (DE)

(73) Assignee: HAWE Altenstadt Holding GmbH, Altenstadt (DE)

( * ) Notice: Subject to any disclaimer, the term of this patent is extended or adjusted under 35 U.S.C. 154(b) by 0 days.

(21) Appl. No.: 17/048,673

(22) PCT Filed: Apr. 1, 2019

(86) PCT No.: PCT/EP2019/058147
§ 371 (c)(1),
(2) Date: Oct. 19, 2020

(87) PCT Pub. No.: WO2019/201579
PCT Pub. Date: Oct. 24, 2019

(65) Prior Publication Data

US 2021/0369513 A1 Dec. 2, 2021

(30) Foreign Application Priority Data

Apr. 19, 2018 (DE) ..... 102018109352.7

(51) Int. Cl.
*A61G 1/013* (2006.01)
*A61G 1/02* (2006.01)

(52) U.S. Cl.
CPC ..... *A61G 1/013* (2013.01); *A61G 1/02* (2013.01)

(58) Field of Classification Search
CPC ..... A61G 1/013; A61G 1/02; A61G 7/012; A61G 7/018; A61G 13/06
(Continued)

(56) References Cited

U.S. PATENT DOCUMENTS 5,701,618 A * 12/1997 Brugger ..... A61G 1/06 254/93 R
7,389,552 B1 6/2008 Reed et al.
(Continued)

FOREIGN PATENT DOCUMENTS

DE 3611437 A1 10/1987
WO WO-9513043 A1 * 5/1995 ..... A61G 3/006
(Continued)

OTHER PUBLICATIONS

International Search Report dated Jul. 22, 2019; International Application No. PCT/EP2019/058147.

*Primary Examiner* — Robert G Santos
(74) *Attorney, Agent, or Firm* — Dinsmore & Shohl LLP

(57) ABSTRACT

In a mobile stretcher, in order to change the height position of a patient support mounted on a chassis, the chassis geometry is modifiable by a hydraulic drive system. The drive system includes a linear actuator, a pressure supply unit, and a receiving space for hydraulic fluid. A manually actuatable unlocking valve unit directly connects a lifting working chamber of the linear actuator to the receiving space. The valve unit has a control space delimited by a piston element movably guided relative to the housing of the valve unit and which communicates with a lifting attachment, which communicates with the working chamber. The piston element is operatively connected to a valve body interacting with a valve seat of a relief valve between the lifting attachment and a tank attachment communicating with the receiving space. A mechanical actuation input acts on the valve body, with a spring element interposed.

13 Claims, 3 Drawing Sheets

(58) Field of Classification Search
USPC ..... 5/611, 600, 11, 625
See application file for complete search history.

(56) References Cited

U.S. PATENT DOCUMENTS

| | | | | |
|---|---|---|---|---|
| 7,398,571 | B2 | 7/2008 | Souke et al. | |
| 7,540,047 | B2 * | 6/2009 | Lambarth | A61G 1/0212 5/611 |
| 7,725,968 | B2 * | 6/2010 | Lambarth | A61G 1/0262 5/611 |
| 7,996,939 | B2 * | 8/2011 | Benedict | A61G 1/0293 5/611 |
| 8,051,513 | B2 * | 11/2011 | Reed | A61G 1/0262 5/627 |
| 8,056,950 | B2 * | 11/2011 | Souke | A61G 1/04 296/20 |
| 8,155,918 | B2 * | 4/2012 | Reed | G01C 9/00 702/150 |
| RE44,884 | E * | 5/2014 | Lambarth | A61G 1/0237 5/611 |
| 2006/0075558 | A1 | 4/2006 | Lambarth et al. | |
| 2008/0211248 | A1 * | 9/2008 | Lambarth | A61G 1/0293 296/20 |
| 2008/0276372 | A1 * | 11/2008 | Lambarth | A61G 1/0237 5/611 |
| 2009/0165207 | A1 * | 7/2009 | Reed | B60T 7/04 5/611 |
| 2009/0165208 | A1 * | 7/2009 | Reed | A61G 1/0243 5/611 |
| 2009/0172883 | A1 * | 7/2009 | Benedict | A61G 1/0293 5/620 |
| 2010/0176618 | A1 * | 7/2010 | Souke | A61G 7/0513 296/20 |

FOREIGN PATENT DOCUMENTS

| | | | | |
|---|---|---|---|---|
| WO | 2005122989 | A1 | 12/2005 | |
| WO | 2006004820 | A1 | 1/2006 | |
| WO | 2006036980 | A1 | 4/2006 | |
| WO | 2009085332 | A1 | 7/2009 | |
| WO | 2011041170 | A2 | 4/2011 | |
| WO | 2011088169 | A1 | 7/2011 | |
| WO | 2014089180 | A1 | 6/2014 | |
| WO | 2014134321 | A1 | 9/2014 | |
| WO | 2015073792 | A2 | 5/2015 | |
| WO | 2016076908 | A1 | 5/2016 | |
| WO | 2019030354 | A1 | 2/2019 | |
| WO | WO-2019201579 | A1 * | 10/2019 | A61G 1/02 |

* cited by examiner

MOBILE STRETCHER

CROSS-REFERENCE TO RELATED APPLICATIONS

This application is the U.S. national stage of PCT/EP2019/058147 filed Apr. 1, 2019, which claims priority of German patent application 102018109352.7 filed Apr. 19, 2018, both of which are hereby incorporated by reference in their entirety.

FIELD OF THE INVENTION

The present invention relates to a mobile rescue stretcher, in particular for transport in ambulance vehicles, comprising a chassis having wheels and a patient stretcher supported by the chassis, wherein the chassis geometry can be changed by means of a hydraulic drive system in order to change the height position of the patient stretcher above the wheels, the hydraulic drive system comprising a pressure supply unit and at least one linear actuator which can be acted upon by the pressure supply unit, wherein the hydraulic drive system further has a manually operable unlocking valve unit for directly connecting a lifting working chamber of the linear actuator with a receiving chamber for hydraulic fluid.

BACKGROUND OF THE INVENTION

Mobile rescue stretchers, as they are used in particular to transport sick or injured persons to or from an ambulance vehicle, are generally known. Various mechanisms are known to adjust the height of the patient stretcher, for example to adjust it to the level of a treatment table after the arrival of the patient in a clinic, thus facilitating the repositioning of the patient with minimal risk, including, as explained at the beginning, hydraulic drive systems. These are also used to retract the chassis of the rescue stretcher—one end of which is already inserted in a corresponding receptacle in the ambulance vehicle—if the latter is to be placed in the ambulance vehicle (loaded or unloaded). Regarding the state of the art please refer to the following documents: WO 2016/076908 A1, WO 2011/088169 A1, WO 2014/134321 A1, WO 2005/122989 A1, WO 2006/004820 A1, WO 2015/073792 A2, WO 2014/089180 A1, WO 2011/041170 A2, WO 2009/085332 A1 and WO 2006/036980 A1

The fact that—with mobile rescue stretchers of this type—a direct connection of a lifting working chamber of the linear actuator with a receiving chamber for hydraulic fluid can be established by means of a manually operated unlocking valve unit serves to save time, which is eminently important in the field of emergency medicine; for example, the patient stretcher can be lowered more or less abruptly for rapid retraction of the chassis if the unloaded rescue stretcher is to be stowed in the ambulance vehicle. Such a manually operated unlocking valve unit for direct connection of a lifting working chamber of the linear actuator with a receiving chamber for hydraulic fluid is, however, delicate in so far as its operation with a loaded patient stretcher bears the risk of serious injuries for the patient concerned. Against this background, various approaches have already been proposed to prevent unintentional actuation of the unlocking valve unit (see, for example, U.S. Pat. No. 7,389,552 B1, WO 2014/089180 A1, U.S. Pat. No. 7,398,571 B2 and WO 2006/036980 A1). However, these approaches have not proven to be optimal in practice. One of the disadvantages is the required installation space for the corresponding mechanics.

The present invention has made it its task to provide a generic mobile rescue stretcher which is improved in terms of its practical suitability compared to the state of the art. In particular, in view of the fact that the installation space is particularly scarce in the case of mobile rescue stretchers of the type at issue here, the space required for the manually operated unlocking valve unit and its actuation mechanism should be particularly small, with a high level of safety with regard to possible maloperation or malfunctions.

According to the invention, this task is solved in that in a generic mobile rescue stretcher, the unlocking valve unit has a control chamber which is limited by a piston element movably guided relative to the housing of the valve unit and communicates with the connection connected to the lifting working chamber, wherein the piston element is operatively connected to a valve body which cooperates with a valve seat of a relief valve formed between the connection connected to the lifting working chamber and the connection connected to the receiving chamber, and wherein furthermore a mechanical actuation input of the valve unit acts on the valve body with a spring element interposed therebetween. Accordingly, the rescue stretcher according to the invention is characterized by a complex unlocking valve unit with integrated safety functionality in such a way that the pressure prevailing in the lifting working chamber of the linear actuator of the hydraulic drive system, which is an indicator for the loading of the patent stretcher, is switched to a control chamber and acts on a piston element arranged therein and connected to a valve body of the relief valve. A mechanical actuation input of the valve unit acts on the valve body with the interposition of a spring element in such a way that—as a result of a suitable adjustment of the spring element to the counterforce exerted on the piston element by the pressure in the control chamber—manual actuation of the mechanical actuation input only up to a predetermined pressure level in the control chamber leads to a displacement of the valve body with opening of the relief valve, whereas, if the pressure in the control chamber is above the specified pressure level, manual actuation of the mechanical actuation input leads to compression of the spring element—with the valve body not changing position and thus the relief valve still closed. A safety function is thus integrated into the unlocking valve unit in a very small space, which prevents hydraulic fluid from flowing directly from the lifting working chamber of the linear actuator into the hydraulic fluid receiving chamber via an opened relief valve when the patient stretcher is loaded—and the patient stretcher lowers rapidly in the process.

According to a first preferred embodiment of the invention, the piston element and the valve body are part of a rigid valve body unit. In particular, the piston element (by screwing, pressing or any other joining technique) can be fixedly attached to the valve body. Through such a connection, the movements of the piston element and valve body are directly coupled. The risk of external influences changing the switching characteristics of the unlocking valve unit, in particular its safety function (see above), is thus minimal. Under special conditions, however, it may also be advantageous, for example, to allow a certain actuation clearance between the piston element and the valve body, that means not to combine the piston element and the valve body in a fixed valve body unit.

Another preferred embodiment of the invention is characterized in that an annular control chamber is provided, which is limited by a piston element having an annular effective surface. This design favors the desired particularly compact, space-saving design of the unlocking valve unit. In the sense of the above-mentioned embodiment, the control chamber is preferably limited radially outside by the housing of the valve unit and radially inside by the valve body unit. The annular control chamber can also contain a closing spring acting on the valve body to close the relief valve. This also contributes to a particularly compact design of the entire unlocking valve unit including the implemented safety functionality.

According to another preferred embodiment of the invention, the spring element—functionally downstream of the mechanical actuation input—acts on the piston element. The spring element can in particular be designed as a coil spring. The coil spring can be dimensioned particularly preferably in such a way that its diameter essentially corresponds to the diameter of the—opposite—effective surface of the piston element. This favors the realization of a spring characteristic that is advantageous for the safety functionality essential here; and in addition, an offset between spring force on the one hand and hydraulic counterforce, as implied by the control pressure prevailing in the control chamber and acting on the effective piston surface, on the other hand is avoided. This is beneficial to the reliability of the function.

It is also advantageous with regard to the reliability of the safety function if a mechanical stop is assigned to the mechanical actuation input, which prevents further movement of the actuation input in a position where the capacity of the spring element is not yet exhausted. The stop in question is preferably formed in or on the housing of the valve unit.

Particularly preferred in the rescue stretcher according to the invention, the valve body of the unlocking valve unit is assigned an actuating element which is coupled to the valve body and can assume a position in which it opens a shut-off valve, which is arranged between a connection connected to the lowering working chamber of the linear actuator and the connection connected to the receiving chamber.

In particular, such an actuating element can form a projection of the valve body, in particular it can be directly formed onto the valve body. The actuating element is particularly preferably dimensioned in such a way that the opening of the shut-off valve—which in the particularly preferred embodiment of the invention is designed as a non-return valve with shut-off direction from the lowering working chamber to the receiving chamber—is slightly offset in relation to the opening of the relief valve. In this case, a movement of the valve body—induced in particular by activation of the mechanical actuation input—causes the valve body to lift off the valve seat of the relief valve before—with a slight delay—the shut-off valve is also opened. If both the relief valve and the shut-off valve are open when the valve body is in the corresponding position, the two working chambers of the linear actuator, that means the lifting working chamber and the lowering working chamber, are directly connected to each other and to the connection to the receiving chamber for hydraulic fluid through the unlocking valve unit. In this way, the chassis can be rapidly extended and retracted, bypassing the pressure supply unit, wherein any difference in volume between the two working chambers is compensated for by a compensating flow to and from the receiving chamber for hydraulic fluid.

In order to influence the speed with which, when the relief valve is open, the patient stretcher lowers with the chassis of the rescue stretcher standing on the floor or the chassis lowers with the patient stretcher raised above the floor, a flow throttle is arranged between the connection connected to the lifting working chamber and the connection connected to the receiving chamber for the hydraulic fluid (fluidically in series with the relief valve), according to another preferred embodiment of the invention.

This flow throttle can be formed in particular annular or in the form of several annular sections, and in particular preferably by means of an annular gap or annular gap sections existing between the valve body and the valve housing. Once again, the required size of the unlocking valve unit benefits from such a design in the sense that it is particularly compact.

Finally, according to another preferred embodiment of the invention, the linear actuator is provided with a pressure relief which is effective at the lifting working chamber of the linear actuator at its maximum volume. In other words, when the patient stretcher is actively brought to its maximum raised position using the hydraulic drive system, the pressure in the lifting working chamber is reduced via the said pressure relief. Thus, the pressure in the lifting working chamber does not remain at the pressure prevailing when the patient stretcher reaches its maximum raised position. For such a pressure reduction, end position reliefs to be used on hydraulic cylinders (e.g. via relief notches) are known. The linear actuator retracts again slightly within the scope of such a relief, that means the permanently loadable end position deviates slightly from the maximum position defined by a stop.

BRIEF DESCRIPTION OF THE DRAWINGS

In the following, the present invention is explained in more detail by means of a preferred embodiment illustrated in the drawing. Therein

DETAILED DESCRIPTION OF THE INVENTION

Figure 1:
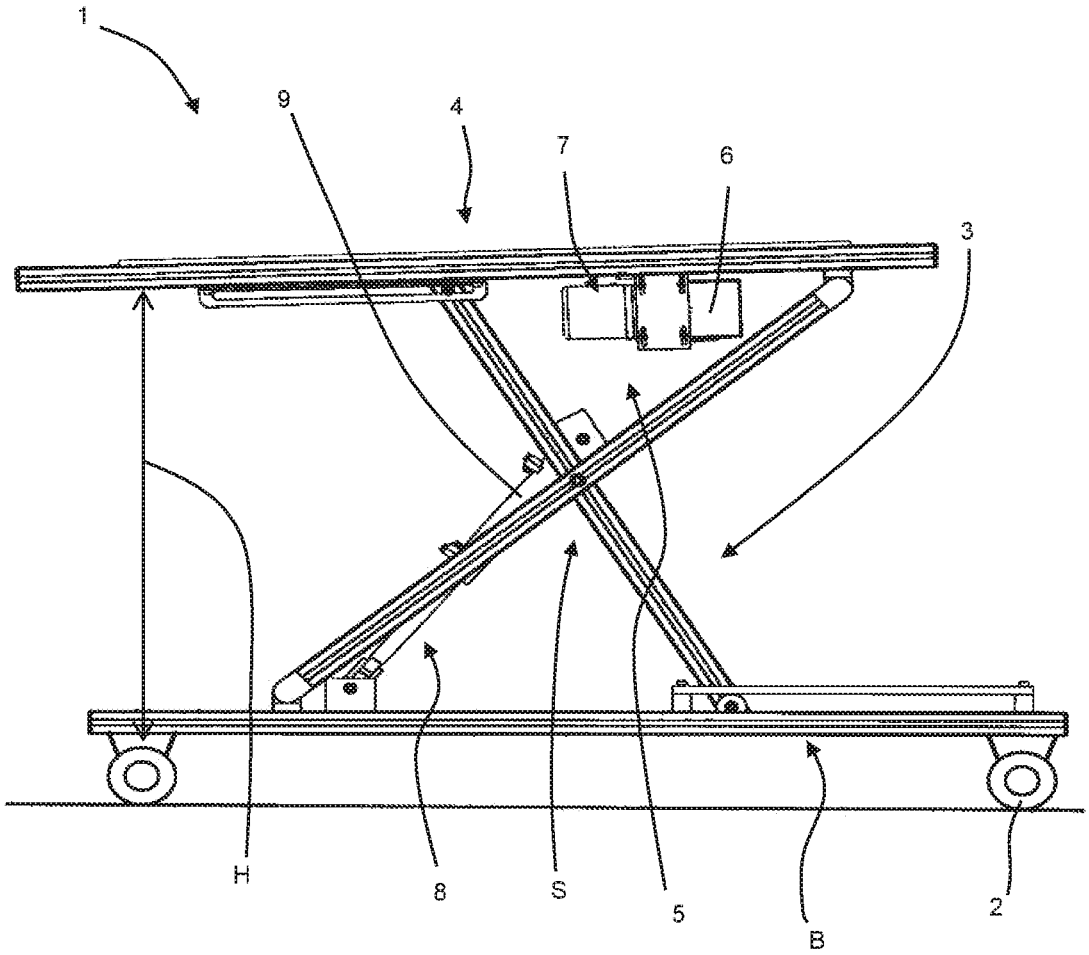
FIG. 1 is a view of a mobile rescue stretcher with a hydraulic drive system for changing the height of the patient stretcher, illustrated with regard to its basic construction.

The mobile rescue stretcher 1 illustrated in FIG. 1—in its fully erected configuration—which is used in particular for the transport of sick or injured persons (patients) in ambulance vehicles, comprises in a manner known as such a mobile rescue stretcher 1 a chassis 3 with four wheels 2 and a patient stretcher 4 supported by this chassis 3. In order to change the height H of the patient stretcher 4 above the wheels 2, the geometry of the chassis 3 comprising a base frame B and a scissors-type lifting structure S can be changed by means of a hydraulic drive system 5, which comprises an receiving chamber 6 for hydraulic fluid, a pressure supply unit 7 and at least one linear actuator 8 which can be acted upon by the pressure supply unit 7 and is effective between the base frame B and the scissors-type lifting structure S. The linear actuator 8 is formed as a double-acting differential cylinder 9. The double-acting differential cylinder 9 is installed in such a way that the piston working chamber 10 forms the lifting working chamber 11, that means that pressurization of the piston working chamber 10 acts in the sense of lifting the patient stretcher 4.

Conversely, the piston rod working chamber 12 forms the lowering working chamber 13, that means pressurization of the piston rod working chamber 12 has the effect of lowering the patient stretcher 4. To this extent the rescue stretcher 1 corresponds to the sufficiently known state of the art, so that further explanations are not necessary.

Figure 2:
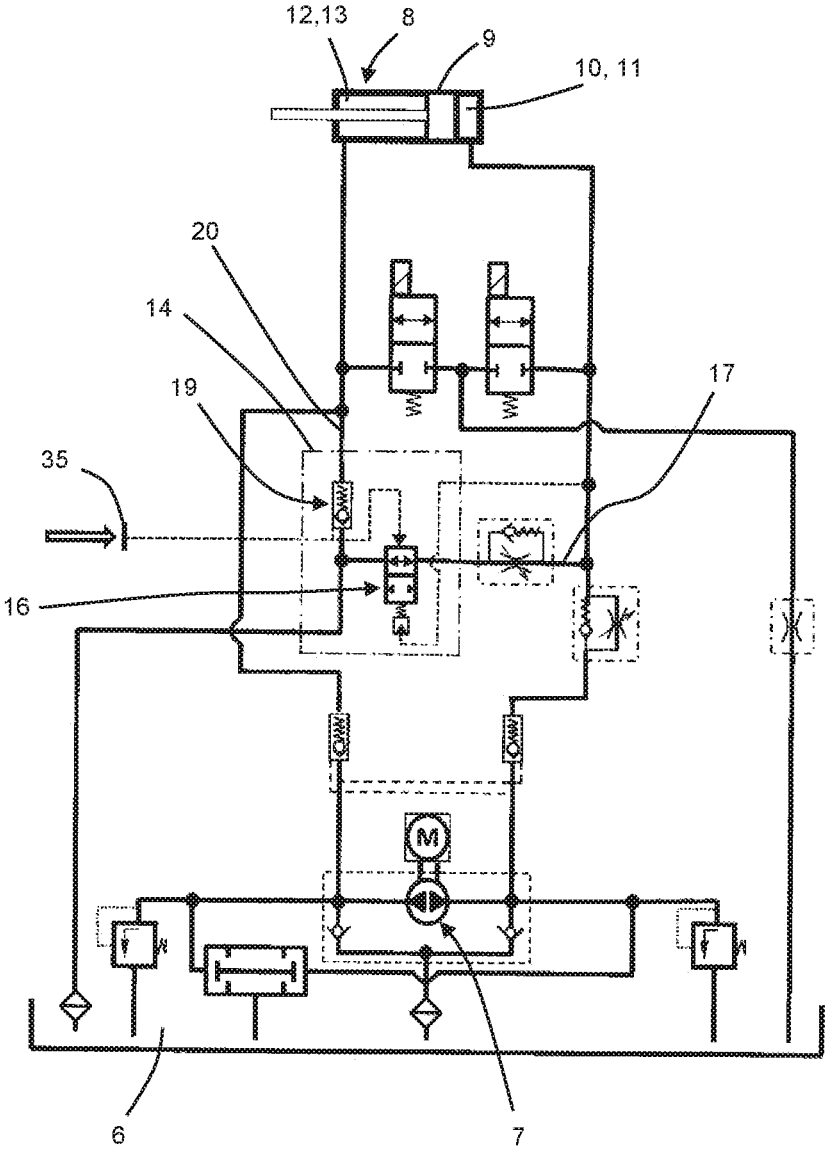
FIG. 2 is a circuit diagram of the hydraulic system of the rescue stretcher according to FIG. 1.

The hydraulic system, the other details of which—which can be readily seen in FIG. 2—are not important for the present invention beyond the following explanations, further comprises a manually operable unlocking valve unit 14. The manually operable unlocking valve unit 14 is suitable for establishing a direct fluidic connection of the lifting working chamber 11 and the lowering working chamber 13 of the linear actuator 8 with each other as well as with the receiving chamber 6 for hydraulic fluid, that means for providing a pressure equalization between lifting working chamber 11, lowering working chamber 13 and receiving chamber 6 for hydraulic fluid. From a functional point of view, the unlocking valve unit 14 comprises a relief valve 16—formed as a seat valve 15—which is arranged in a flow path 17 extending from the lifting working chamber 11 to the receiving chamber 6, as well as a shut-off valve 19—formed as a pilot-operated non-return valve 18—which is arranged in a flow path 20 extending from the lowering working chamber 13 to the receiving chamber 6.

Figure 3:
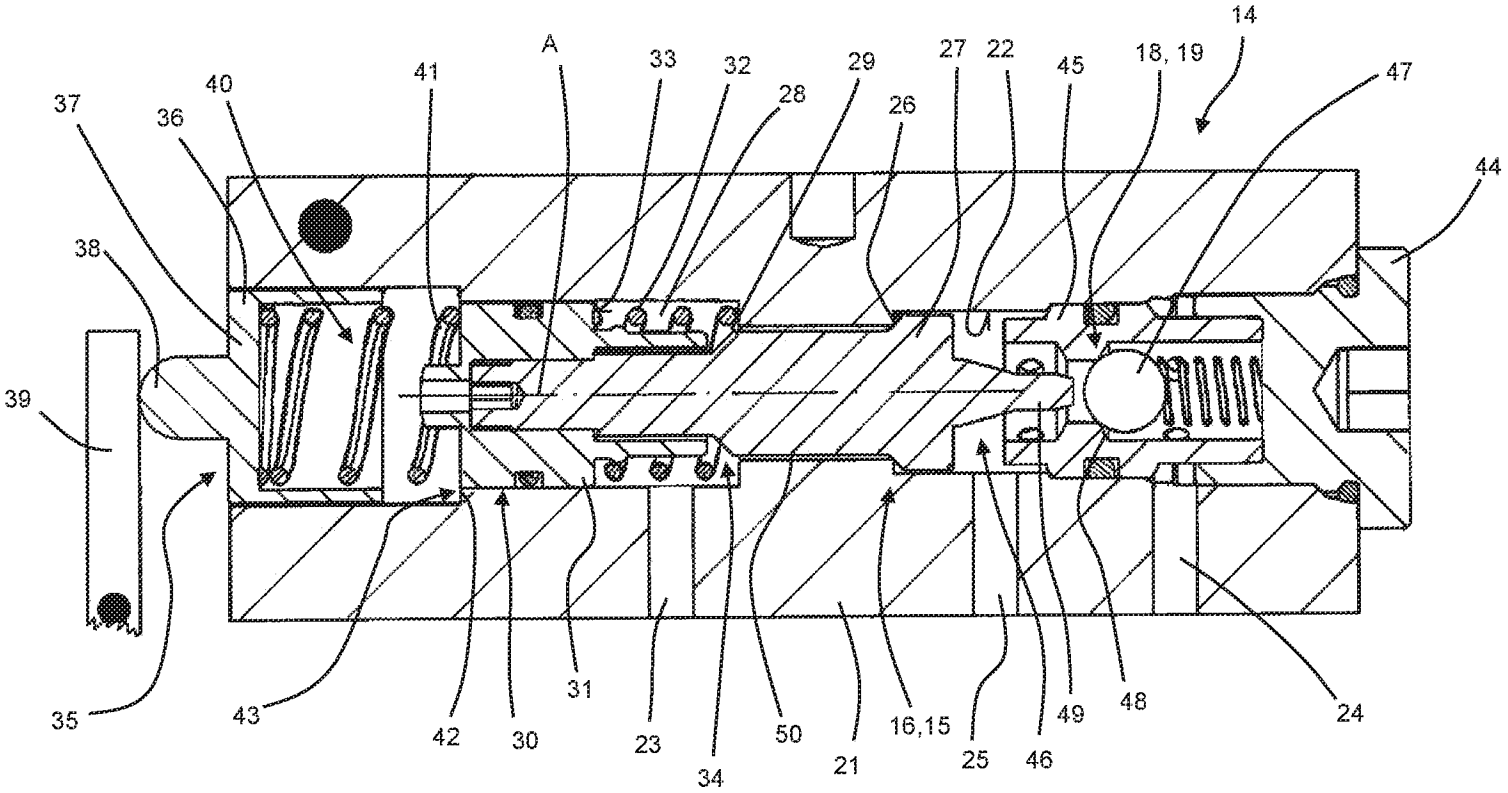
FIG. 3 is a sectional view through the unlocking valve unit used with the hydraulic system according to FIG. 2.

The configuration of the unlocking valve unit 14 is illustrated in FIG. 3. It comprises a housing 21 with a receiving bore 22 for receiving the valve internals, into which three connections open, namely a lifting connection 23 communicating with the lifting working chamber 11, a lowering connection 24 communicating with the lowering working chamber 13 and a tank connection 25 communicating with the receiving chamber 6.

Between the openings of the lifting connection 23 and the tank connection 25, a valve seat 26 of the relief valve 16 is formed in the receiving bore 22. A valve body 27, which can be moved along the axis A in the receiving bore 22, interacts with the valve seat 26. The lifting connection 23 opens into an annular control chamber 28, which is limited radially outside by the housing 21 and radially inside by the valve body 27 and is axially limited on the one hand by a collar 29, in which the valve body 27 is guided, and on the other hand by a piston element 30, which is mounted on the valve body 27 and has an annular piston 31 guided sealingly in the receiving bore 22. A closing spring 32 is arranged in the control chamber 28, which is supported on the collar 29 and—in the area of its annular hydraulically effective surface 33—acts on the piston element 30 (and thus indirectly on the valve body 27, with which the piston element 30 is rigidly connected to form a rigid valve body unit 34) in the sense of closing the relief valve 16.

The unlocking valve unit 14 also has a mechanical actuation input 35 in the form of a plunger 36 which can be moved along the axis A in the receiving bore 22. The plunger 36 is approximately cup-shaped with an actuating pin 38 projecting from the base 37, onto which a lever 39 acts, which in turn can be coupled, for example, via a Bowden cable with an unlocking handle. A spring element 40 is interposed between the plunger 36 and the valve body unit 34, so that the plunger 36 can only act on the valve body unit 34 via the spring element 40. The spring element 40 is formed as a coil spring 41, which extends between the bottom 37 of the plunger 36 and the piston element 30 of the valve body unit 34. A step 42 formed in the receiving bore 22 represents a mechanical stop 43 for the plunger 36, which limits the movement path of the plunger 36 in a position in which the compression capability (capacity) of the coil spring 41 is not yet exhausted.

A valve insert 45 is also located in the receiving bore 22, adjacent to the plug 44 inserted at the front. This valve insert 45 contains the check valve 18, which is the above-mentioned shut-off valve 19 located between tank connection 25 and lowering connection 24.

The check valve 18 blocks the flow direction from the lowering connection 24 to the tank connection 25. It can be mechanically unlocked. For this purpose, the valve body 27 comprises an actuating element 46 in the form of an unlocking pin 49 which—if the valve body 27 is in the appropriate position—acts on the valve ball 47 and lifts it off the seat 48. If there is such a pressure in control chamber 28—which is above a predetermined pressure level—that the hydraulic force exerted on the piston element 30 is greater than the force transmittable by the coil spring 41, pressing in the plunger 36 causes the coil spring 41 to be compressed. The valve body unit 34 does not move and the relief valve 16 remains closed, as does the shut-off valve 19. If, however, there is such a pressure in control chamber 28—which is below a predetermined pressure level—that the hydraulic force exerted on the piston element 30 is less than the force that can be transmitted by the coil spring 41, pressing in the plunger 36 causes the valve body unit 34 to move and consequently the relief valve 16 and the shut-off valve 19 to open. The fluidic connection between the lifting connection 23 and the tank connection 25 is established via a flow throttle 50 arranged in series with the relief valve 16, which is formed by several ring sections in the area of the collar 29 between the valve body 27 and the valve housing 21.

The invention claimed is:

1. A mobile rescue stretcher, comprising:

a chassis having wheels and a chassis geometry;

a patient stretcher supported by the chassis;

a hydraulic drive system operable to change the chassis geometry in order to change a height of the patient stretcher above the wheels, the hydraulic drive system comprising;

a pressure supply unit;

a receiving chamber for hydraulic fluid;

at least one linear actuator which can be acted upon by the pressure supply unit, the at least one linear actuator having a lifting working chamber; and a manually operable unlocking valve unit for directly connecting the lifting working chamber of the at least one linear actuator with the receiving chamber for hydraulic fluid, the unlocking valve unit comprising;

a housing having a lifting connection in communication with the lifting working chamber of the at least one linear actuator and a tank connection in communication with the receiving chamber;

a piston element movably guided relative to the housing;

a control chamber which is limited by the piston element, the control chamber communicating with the lifting connection;

a relief valve formed between the lifting connection and the tank connection of the housing, the relief valve having a valve seat;

a valve body cooperating with the relief valve, the piston element being operatively connected to the valve body;

a mechanical actuation input operable to act on the valve body; and a spring element interposed between the mechanical actuation input and the valve body.

2. A rescue stretcher according to claim 1, wherein the piston element and the valve body are part of a rigid valve body unit.

3. A rescue stretcher according to claim 1, wherein the control chamber is of annular design and is limited by an annular effective surface of the piston element.

4. A rescue stretcher according to claim 1, wherein the spring element acts on the piston element.

5. A rescue stretcher according to claim 1, further comprising a mechanical stop for the mechanical actuation input, the mechanical stop preventing further movement of the actuation input in a position in which, with the relief valve closed, the capacity of the spring element is not yet exhausted.

6. A rescue stretcher according to claim 1, wherein:

the at least one linear actuator further comprises a lowering working chamber;

lowering the housing of the valve unit further comprises a lowering connection connected to the working chamber;

the valve unit further comprising a shut-off valve arranged between the lowering connection and the tank connection and an actuating element coupled to the valve body and which can assume a position in which it opens the shut-off valve.

7. A rescue stretcher according to claim 6, wherein the shut-off valve is designed as a non-return valve with a shut-off direction from the lowering connection to the tank connection.

8. A rescue stretcher according to claim 1, further comprising a closing spring operable to close the relief valve and acting on the valve body.

9. A rescue stretcher according to claim 8, wherein the closing spring is disposed in the control chamber.

10. A rescue stretcher according to claim 1, further comprising a flow throttle disposed between the lifting connection and the tank connection in series with the relief valve.

11. A rescue stretcher according to claim 10, wherein the flow throttle is formed between the valve body and the housing.

12. A rescue stretcher according to claim 10, wherein the flow throttle is disposed between the control chamber and the relief valve.

13. A rescue stretcher according to claim 1, wherein the at least one linear actuator has a pressure relief which is effective at the lifting working chamber of the at least one linear actuator at its maximum volume.

* * * * *